US006368158B1

(12) United States Patent
Kan

(10) Patent No.: US 6,368,158 B1
(45) Date of Patent: Apr. 9, 2002

(54) ELECTRIC CONNECTOR HAVING INTEGRALLY MOLDED TERMINALS AND GUIDE PINS

(76) Inventor: Chin-Mao Kan, No.20, Ln.211, Pu Chung Rd., ChungLi, Tao Yuan (TW)

( * ) Notice: Subject to any disclaimer, the term of this patent is extended or adjusted under 35 U.S.C. 154(b) by 0 days.

(21) Appl. No.: 09/616,908

(22) Filed: Jul. 14, 2000

(51) Int. Cl.[7] ..... H01R 24/00

(52) U.S. Cl. ..... 439/676; 439/344; 439/606; 439/736; 439/874

(58) Field of Search ..... 439/676, 604, 439/606, 736, 344, 881, 760, 874

(56) References Cited

U.S. PATENT DOCUMENTS 4,231,628 A * 11/1980 Hughes et al. ..... 339/17
5,626,497 A * 5/1997 Bouchan et al. ..... 439/676
5,790,660 A * 8/1998 Vlaeminck ..... 379/442
6,210,235 B1 * 4/2001 Wu ..... 439/676

* cited by examiner

*Primary Examiner*—Tho D. Ta
*Assistant Examiner*—Truc Nguyen
(74) *Attorney, Agent, or Firm*—Troxell Law Office PLLC

(57) ABSTRACT

An improved electric connector includes a socket, a plug, a plurality of terminals and a pair of guide pins. The socket has a cavity inside and a plurality of slots. The terminals and guide pins are made by punching a terminal plate. The terminals and guide pins are then integrally formed with the plug through plastics injection molding process. The plug may be made by separated and simple molds and be held together by the guide pins. Production time and cost may be greatly reduced. Terminals may be positioned and embedded in the plug precisely to result in precise engagement of the terminals and slots for reducing or preventing short circuit and interference.

6 Claims, 6 Drawing Sheets

ELECTRIC CONNECTOR HAVING INTEGRALLY MOLDED TERMINALS AND GUIDE PINS

1. FIELD OF THE INVENTION

This invention relates to an improved electric connector and particularly to an electric connector that is made by means of integral plastics injection molding process for obtaining higher quality at a lower cost.

2. BACKGROUND OF THE INVENTION

Electrical connectors have been widely used in all sorts of electric and electronic products nowadays. One of the contemporary trends for designing electric and electronic products is slim size and light weight. Connectors design and construction have also to meet such a trend. FIG. 1 shows a conventional electric connector which generally includes a socket A, a plug B and a plurality of terminals C. The socket A has a slot cavity D in a rear end and a plurality of slots E formed in the slot cavity D. The plug B includes a vertical body F which has a plurality of through bores J formed therein and a horizontal beam G which has a plurality of grooves H formed thereon. Each groove forms a notch I at the free end of the beam G. There is a terminal C which has one end passing through the bore J and extending outside the vertical body F and another end laid in the groove H and bent over the notch I to form a slant angle suspending below the horizontal beam G at a side opposite to the grooves H. Then the plug B combined with the terminals C may be inserted into the socket A, with the suspending end of the terminal C engaging with a slot E. The plug B further has a pair of snap noses K located on two side walls engageable with two latch openings L formed in the socket A for securely holding the plug B in the socket A at the final assembly.

In the conventional connector set forth above, the plug B is formed in an L shape manner. The terminals C cannot be integrally made with the plug B because of the peculiar shape of the plug B makes the injection mold difficult or impossible to make. Hence the terminals C have to be made separately and then be inserted and assembled in the plug B. Production and assembly time become lengthy and cost is higher. More over it often happens that the terminals C cannot be neatly and smoothly fitted into the grooves H, and the suspending end of the terminals C cannot be precisely positioned to fit into the slots E. As a result, it may cause short circuit or interference. All this begs for improvement.

SUMMARY OF THE INVENTION

It is an object of this invention to provide an improved electric connector that includes a socket, a plug, terminals and guide pins in which the plug and terminals and guide pins may be integrally produced at large quantity at a lower cost and less production time.

It is another object of this invention to provide an improved electric connector in which the terminals and plug may be integrally made by plastics injection molding process. The terminals thus may be positioned precisely and held securely in the plug without causing terminal misalignment. Short circuit or interference may be greatly reduced or avoided.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
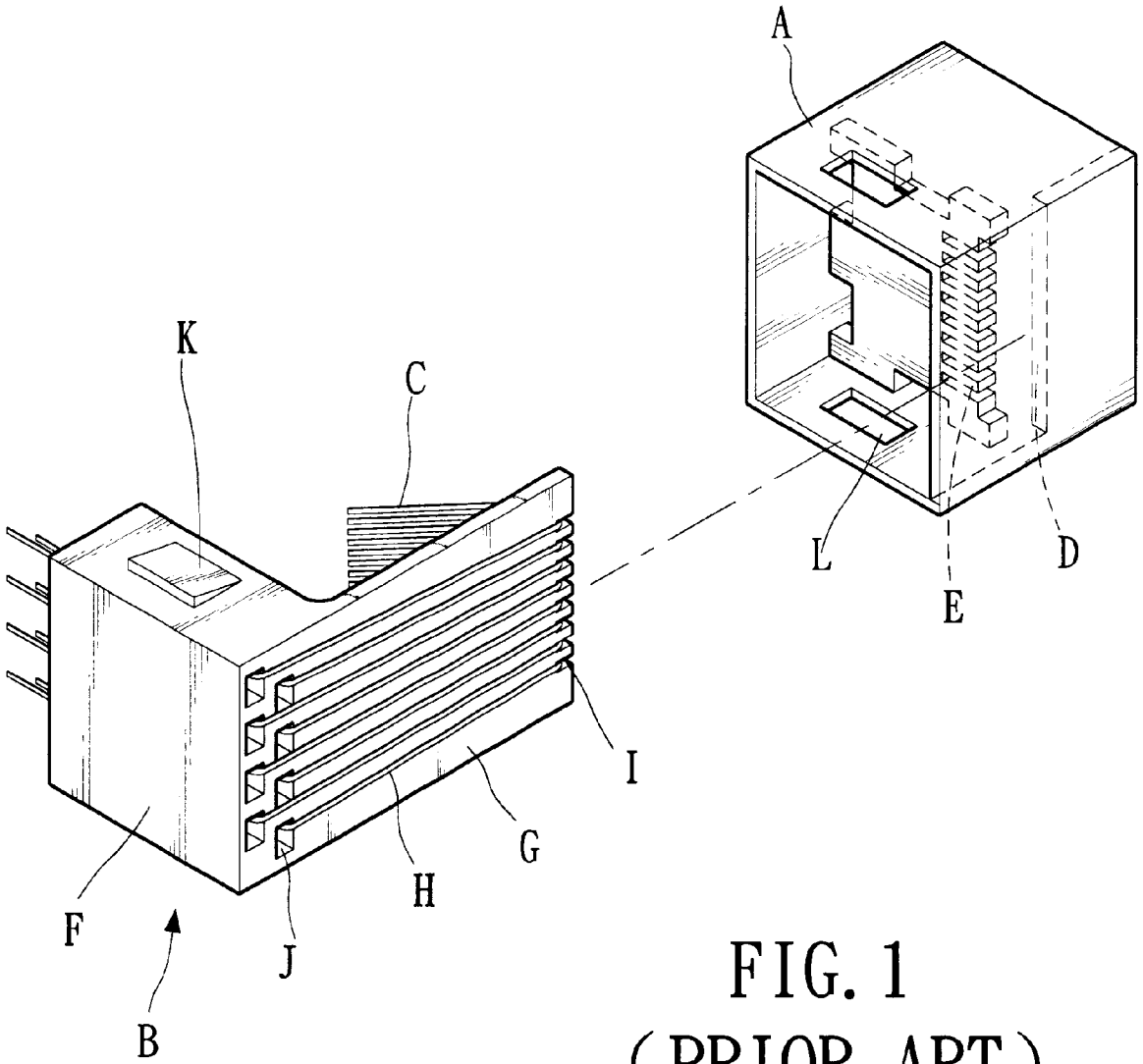
FIG. 1 (PRIOR ART)
FIG. 1 is an exploded view of a conventional electric connector.
Figure 2:
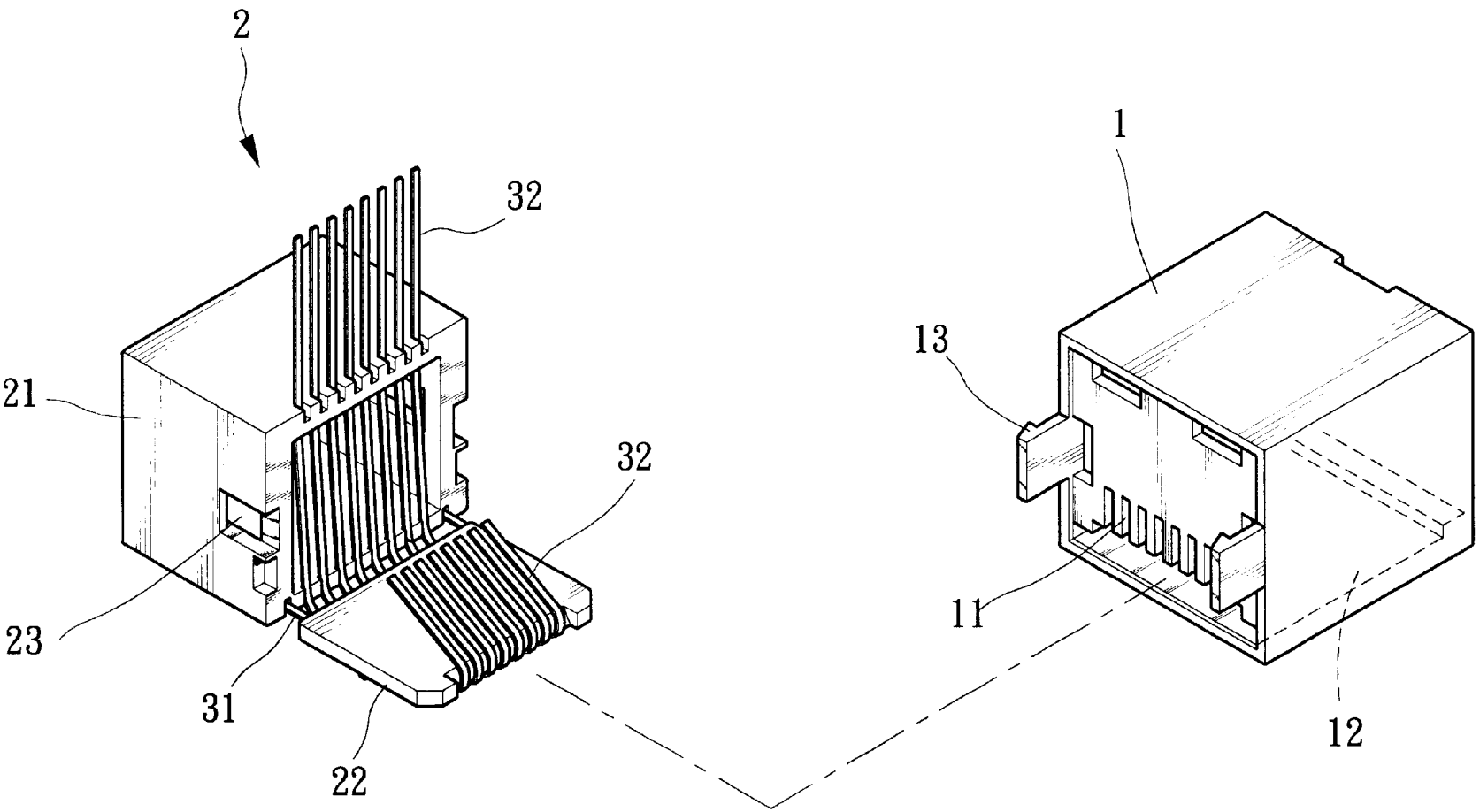
FIG. 2 is an exploded view of this invention.
Figure 3:
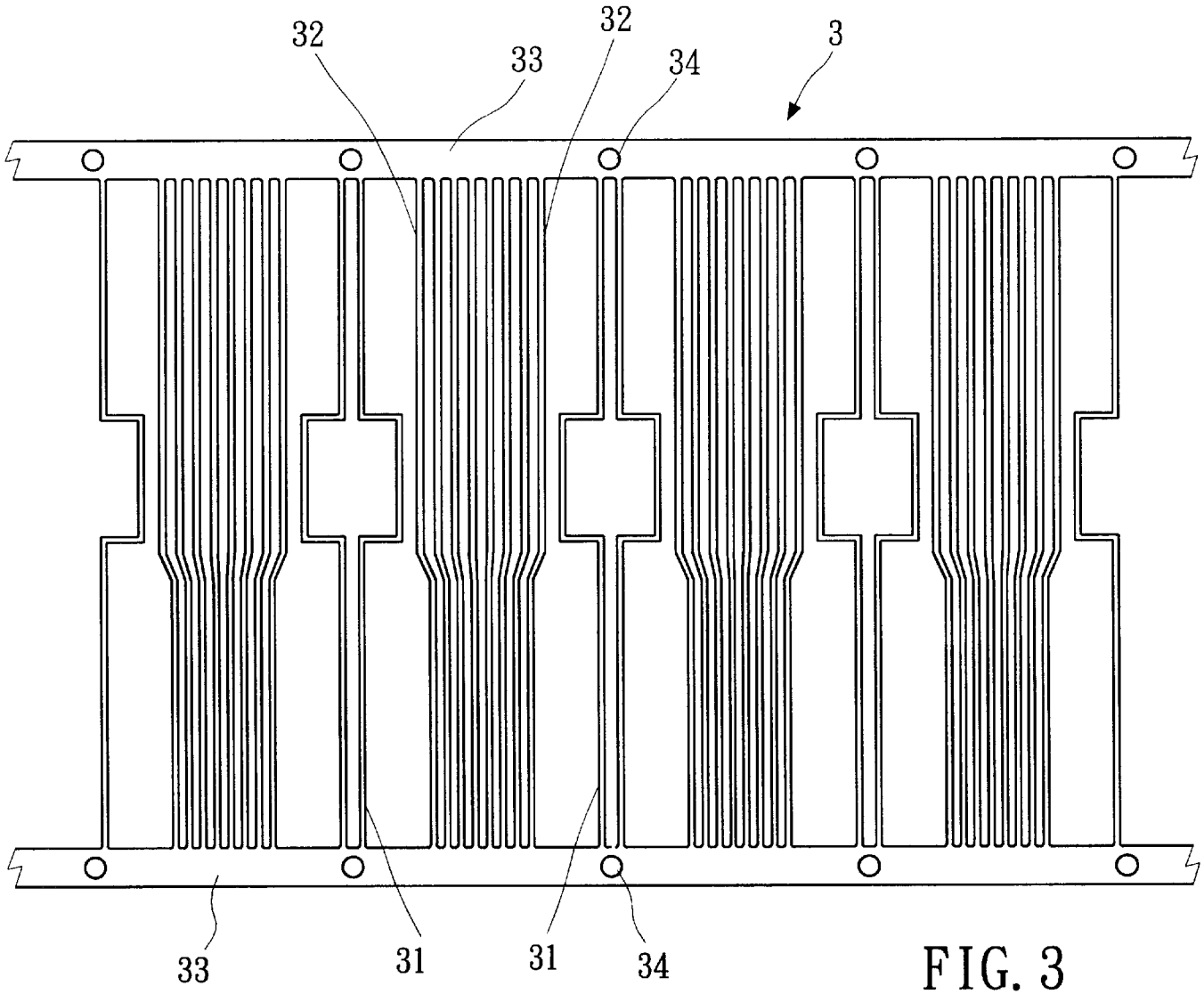
FIG. 3 is a front view of terminals punch plate for this invention.

Referring to FIG. 2, the electric connector according to this invention includes a socket 1, a plug 2, guide pins 31 and terminals 32. The socket 1 has a slot cavity 12 formed therein, a plurality of slots 11 and a pair of snap hooks 13 located at two sides.

Figure 4:
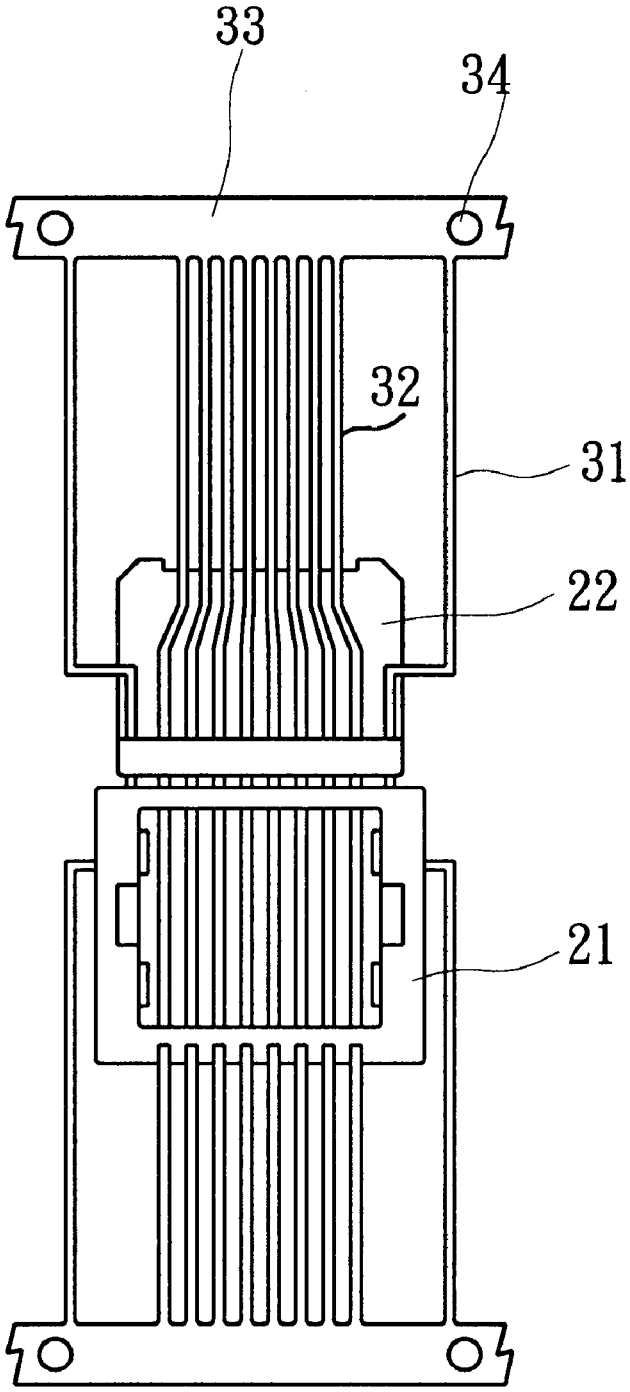
FIG. 4 is a front view of a plug after being made by injection molding process.
Figure 5:
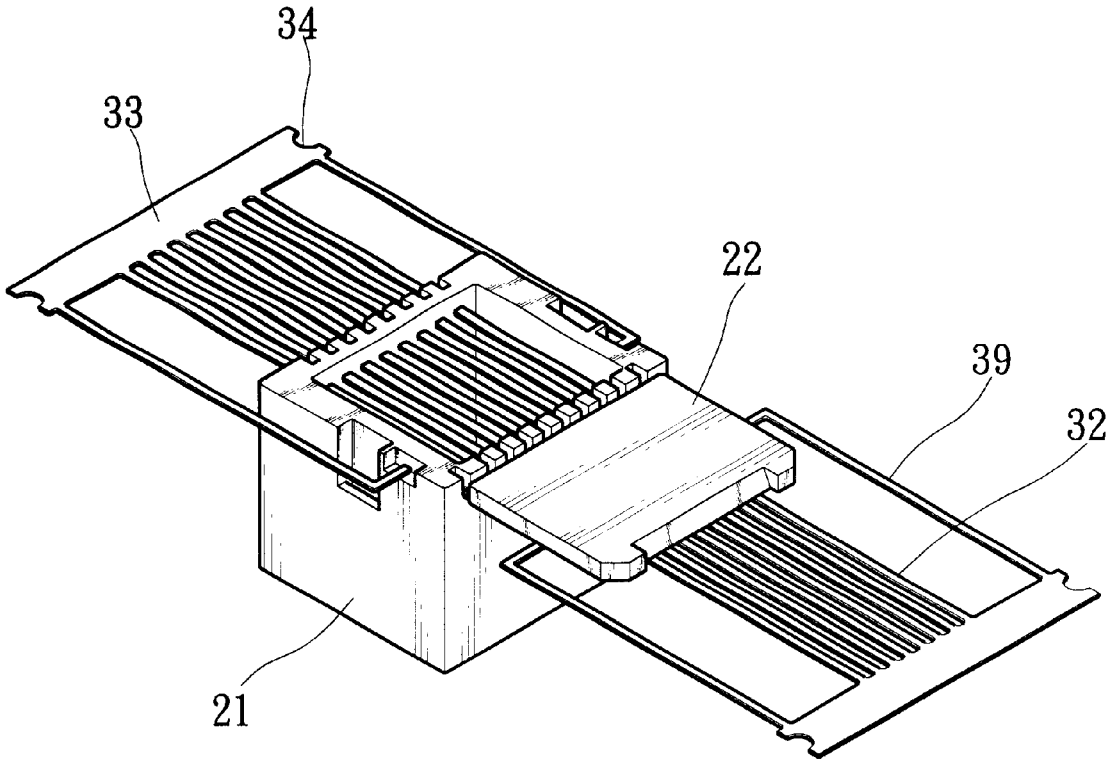
FIG. 5 is a perspective view of the plug shown in FIG. 4, before being bent vertically.
Figure 6:
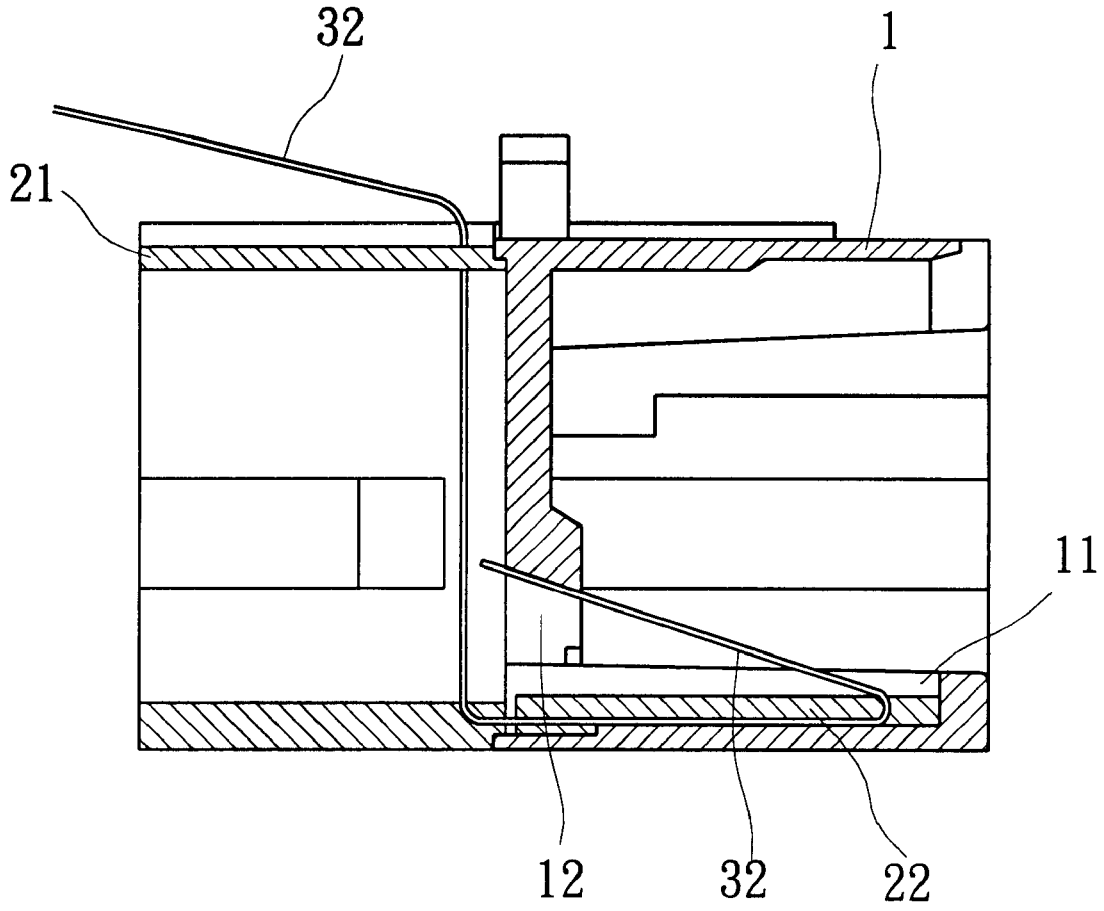
FIG. 6 is a sectional view of this invention after assembly.

Referring to FIGS. 4 and 5, after one set of terminals 32 and guide pins 31 being removed from the metallic plate 3, it may be placed in an injection mold to be integrally combined with the vertical body 21 and horizontal beam 22 of the plug by means of plastics injection molding process. At this stage, the vertical body 21 and horizontal beam 22 are separated and facing up. The injection molds are relatively simple and technically possible. Portion of the terminals 32 and guide pins 31 are embedded in the plug. Then the bordering strips 33 may be cutoff. The terminal ends extending out of the horizontal beam 22 may be bent to another side (FIG. 2) to form a slant angle desired. Afterward the horizontal beam 22 may be bent normal to the top surface of the vertical body 21, and the guide pins 31 are bridged between the horizontal beam 22 and vertical body 21 to hold them together to form a completed plug 2. Then the completed plug 2 may be inserted into the socket to have one terminal 32 engaging with one slot 11 to become a finished connector (FIG. 6). The plug 2 also has a pair of latch slots 23 at two sides for engaging with the snap hooks 13 to ensure secured fastening between the socket 1 and the plug 2.

Because of the addition of the guide pins 31 in this invention, the vertical body 21 and horizontal beam 22 may be made by separated injection molds, and then be connected together. Mold design is easier. Integral injection molding process of the plug and terminals thus become possible and practical. It thus may greatly shorten production time and cost. The terminals may also be positioned in the plug precisely which in turn may make precise engagement with the socket to reduce or prevent short circuit or interference.

It may thus be seen that the objects of the present invention set forth herein, as well as those made apparent from the foregoing description, are efficiently attained. While the preferred embodiment of the invention has been set forth for purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. An electrical connector comprising:

a) a socket having a slot cavity;

b) a plug body having a face;

c) a plurality of spaced apart, parallel elongated terminals, each having a first portion integrally molded into the plug body, and a second portion extending outwardly from the face of the plug body;

d) a plurality of guide pins, each having a first portion integrally molded into the plug body and a second portion extending outwardly from the face of the plug body;

e) a beam member integrally molded to the second portions of the terminals and the second portions of the guide pins so as to enclose the second portions of the guide pins, the beam member being spaced from the plug body and extending normal to the face of the plug body; and, f) an attaching device to attach the plug body to the socket such that the beam member engages the slot cavity.

2. The electrical connector of claim 1 wherein each of the plurality of terminals has a third portion extending at an acute angle to the beam member.

3. The electrical connector of claim 1 wherein the attaching device comprises:

a) at least one latch slot on one of the plug body and socket; and, b) at least one snap hook on the other of the plug body and socket engaging the at least one slot.

4. An electrical plug comprising:

a) a plug body having a face;

b) a plurality of spaced apart, parallel elongated terminals, each having a first portion integrally molded into the plug body, and a second portion extending outwardly from the face of the plug body;

c) a plurality of guide pins, each having a first portion integrally molded into the plug body and a second portion extending outwardly from the face of the plug body; and, d) a beam member integrally molded to the second portions of the terminals and the second portions of the guide pins so as to enclose the second portions of the guide pins, the beam member being spaced from the plug body and extending normal to the face of the plug body.

5. The electrical plug of claim 4 wherein each of the plurality of terminals has a third portion extending at an acute angle to the beam member.

6. A method of making an electrical plug comprising the steps of:

a) forming a metallic plate into a pair of spaced apart bordering strips with a plurality of terminals and a plurality of guide pins extending between and connected to the bordering strips;

b) integrally molding a plug body onto a first portion of the terminals and a first portion of the guide pins such that the first portions of the terminals are adjacent to a face of the plug body;

c) integrally molding a beam member onto a second portion of the terminals and a second portion of the guide pins such that the beam member is spaced from the plug body and such that the beam member is generally parallel to the face of the plug body;

d) cutting off the bordering strips from the terminals and the guide pins;

e) bending a third portion of the terminals to form an acute angle to the beam member; and, f) bending the terminals and the guide pins between the spaced apart plug body and beam member such that the beam member extends normal to the face of the plug body.

* * * * *